United States Patent [19]

Knierim

[11] Patent Number: 4,755,810

[45] Date of Patent: Jul. 5, 1988

[54] FRAME BUFFER MEMORY

[75] Inventor: David L. Knierim, Wilsonville, Oreg.

[73] Assignee: Tektronix, Inc., Beaverton, Oreg.

[21] Appl. No.: 720,659

[22] Filed: Apr. 5, 1985

[51] Int. Cl.[4] ..... G09G 1/16

[52] U.S. Cl. ..... 340/726; 340/748; 340/750; 340/798; 340/799

[58] Field of Search ..... 340/726, 724, 750, 798, 340/799, 800, 748

[56] References Cited

U.S. PATENT DOCUMENTS

| | | | |
|---|---|---|---|
| 4,517,654 | 5/1985 | Carmean | 340/726 |
| 4,566,002 | 1/1986 | Miura et al. | 340/750 |
| 4,617,564 | 10/1986 | Yoshioka | 340/798 |
| 4,642,794 | 2/1987 | LaVelle et al. | 340/726 |
| 4,663,617 | 5/1987 | Stockwell | 340/726 |
| 4,694,406 | 9/1987 | Shibui et al. | 340/726 |

*Primary Examiner*—Gerald L. Brigance

*Attorney, Agent, or Firm*—Daniel J. Bedell; Robert S. Hulse

[57] ABSTRACT

A frame buffer memory has a random access memory (RAM) for storing pixel data words, each word containing pixel data corresponding to a separate set of a plurality pixels along a horizontal raster line of a screen display. Each word is separately addressed. The RAM is organized into tiles, with each tile comprising an array of pixel data word rows and columns corresponding to a separate rectangular subset of horizontally and vertically contiguous display pixels. The RAM is addressed by sequentially applying row and column addresses. A first subset of the column address determines which pixel word row within each tile is addressed, while and a second subset of the column address determines which pixel word column within each tile is addressed. All other bits of the row and column addresses determine which tile is addressed.

Means are provided to selectively increment or decrement the first and second subsets of the column address without changing any other address bits, such that words within a selected tile row or column may be successively addressed allowing rapid reading and writing of sequences of pixel data corresponding to contiguous rows or columns of display pixels.

A first-in, first-out buffer, provided to store the sequences of data read from the RAM, also includes a barrel shifter to shift bit positions of the data words so stored to facilitate proper pixel alignment during a horizontal scrolling operation.

A logic circuit is provided to rapidly modify sequences of data read from the RAM and stored in the buffer prior to rewriting the data to the RAM thereby allowing rapid alteration of pixel attributes.

11 Claims, 2 Drawing Sheets

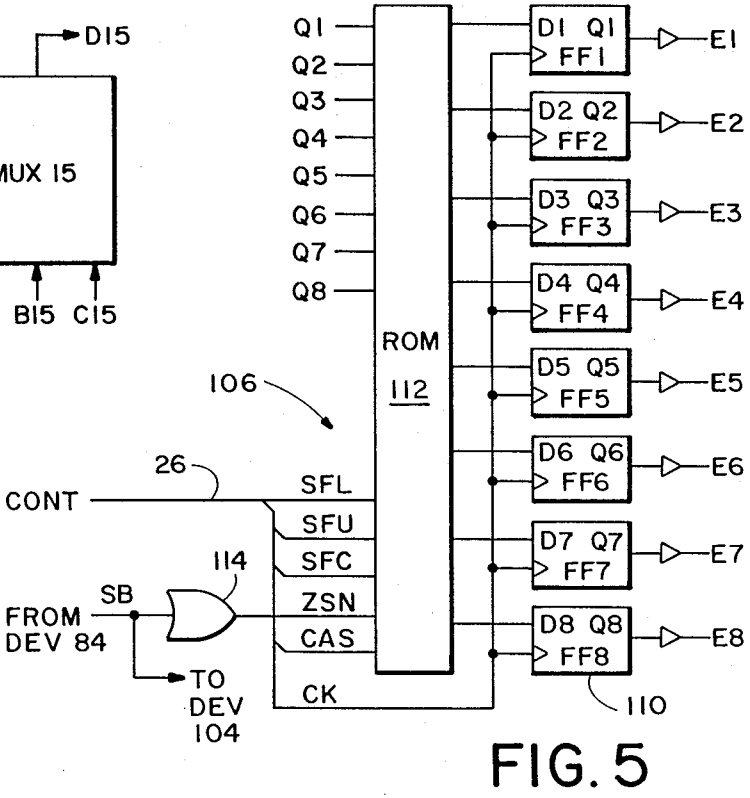

FIG. 5

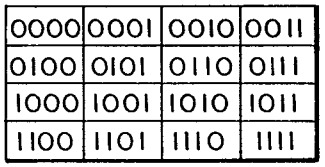

| | | | |
|---|---|---|---|
| 0000 | 0001 | 0010 | 0011 |
| 0100 | 0101 | 0110 | 0111 |
| 1000 | 1001 | 1010 | 1011 |
| 1100 | 1101 | 1110 | 1111 |

FIG. 2

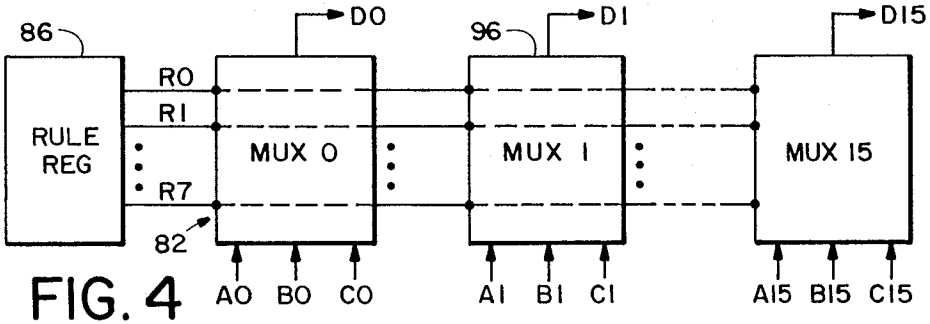

FIG. 4

| F-F INPUT | BOOLEAN EXPRESSION |
|---|---|
| D1 | $(\overline{Q1}\cdot\overline{Q2})+(CN\cdot SFL)$ |
| D2 | $(\overline{Q1}+\overline{Q2})\cdot\overline{Q3}\cdot SFC$ |
| D3 | $(\overline{Q1}+\overline{Q2}+\overline{Q3})\cdot\overline{Q4}\cdot SFC$ |
| D4 | $(\overline{Q1}+\overline{Q2}+\overline{Q3}+\overline{Q4})\cdot\overline{Q5}\cdot SFC$ |
| D5 | $(\overline{Q1}+\overline{Q2}+\overline{Q3}+\overline{Q4}+\overline{Q5})\cdot(Q5+\overline{Q6}+(Q4\cdot ZSN))\cdot SFC$ |
| D6 | $(\overline{Q6}\cdot\overline{Q7})+[\overline{Q5}\ Q6\cdot(\overline{Q4}+\overline{ZSN})]$ |
| D7 | $(\overline{Q6}+\overline{Q7})\cdot\overline{Q8}\cdot SFC$ |
| D8 | $(\overline{Q6}+\overline{Q7}+\overline{Q8})\cdot SFU\cdot SFC$ |

FIG. 6

FRAME BUFFER MEMORY

BACKGROUND OF THE INVENTION

The present invention relates to frame buffer memory systems for raster displays, and more particularly to an apparatus for facilitating rapid scrolling of raster displays in either vertical or horizontal directions.

Raster scan frame buffer displays have become increasingly popular as the price of semiconductor memory has decreased. The image to be displayed is represented in a large memory that saves a digital representation of the intensity and/or color or each picture element, or pixel, on the screen. By properly recording the data in the memory an arbitrary image can be displayed, making the display hardware insensitive to image content. The frame buffer memory is equipped with hardware to generate a video signal to refresh the display and with a memory port to allow a host computer or display processor to change the frame buffer memory in order to change the image being displayed.

Interactive graphics applications require rapid changes to the frame buffer memory. Although the speed of the host display processor is clearly important to high performance, so also are the properties of the memory system, particularly update bandwidth, the rate at which the host processor or data processor may access the frame buffer memory. For a given memory technology the implicit geometry of frame buffer memory access can affect this rate.

The process of scrolling an image, or a portion of an image on a screen involves reading pixel data from one area of a frame buffer memory and writing it to another area. In the prior art, frame buffer memories have been arranged such that groups of pixels along scan lines are stored at sequentially addressed memory locations. Scrolling speed has been improved by providing first in, first out (FIFO) buffers for storing several words of pixel data rapidly read from such sequential memory addresses, with the low bits of the addresses being rapidly incremented by a counter rather than by the host display controller. The data stored in the FIFO buffer is then written back into memory at the new address sequence also utilizing the counter to rapidly increment the address. While this approach improves scrolling speed, further improvement in scrolling speed is desirable.

SUMMARY OF THE INVENTION

According to one aspect of the invention, a frame buffer memory has a random access memory (RAM) for storing pixel data in groups, each group containing pixel data corresponding to a separate set of a plurality of pixels along a horizontal raster line of a display. Each group is separately addressed. The RAM is organized into tiles, with each tile comprising an array of pixel data group rows and columns corresponding to a separate rectangular subset of horizontally and vertically contiguous display pixels. The RAM is addressed by sequentially applying row and column addresses. A first subset of the column address determines which pixel group row within each tile is addressed, while a second subset of the column address determines which pixel group column within each tile is addressed. All other bits of the row and column addresses determine which tile is addressed. In this arrangement, locations within the RAM sharing a common row address but with differing column addresses can be sequentially accessed at a higher rate than locations with differing row addresses. According to a further aspect of the invention, a first-in, first-out buffer, provided to store the sequences of data read from the RAM, also includes a barrel shifter to shift bit positions of the data groups so stored to facilitate proper pixel alignment during a horizontal scrolling operation.

According to another aspect of the invention, means are provided to selectively increment or decrement the first and second subsets of the column address without changing any other address bits, such that groups within a selected tile row or column may be successively addressed in any order. This provides rapid addressing of sequences of pixel data corresponding to contiguous rows or columns of display pixels and facilitates rapid scrolling of a display window in any vertical or horizontal direction.

According to a still further aspect of the invention, a logic circuit is provided to rapidly modify sequences of data read from the RAM and stored in the buffer prior to rewriting the data to the RAM thereby allowing rapid alteration of pixel attributes.

It is an object of the present invention to provide an improved frame buffer memory system permitting rapid horizontal and vertical scrolling and alteration of pixel data.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DRAWINGS

FIG. 1 is a block diagram of a frame buffer memory system employing the present invention, FIG. 2 is a chart of the addressing of a memory tile, FIG. 3 is a block diagram of a data controller of FIG. 1, FIG. 4 is a block diagram of the rasterop combination logic circuit of FIG. 3, FIG. 5 is a block diagram of the FIFO control circuit of FIG. 2, and FIG. 6 is a table of input and output relations for the read only memory at FIG. 5.

DETAILED DESCRIPTION

Figure 1:
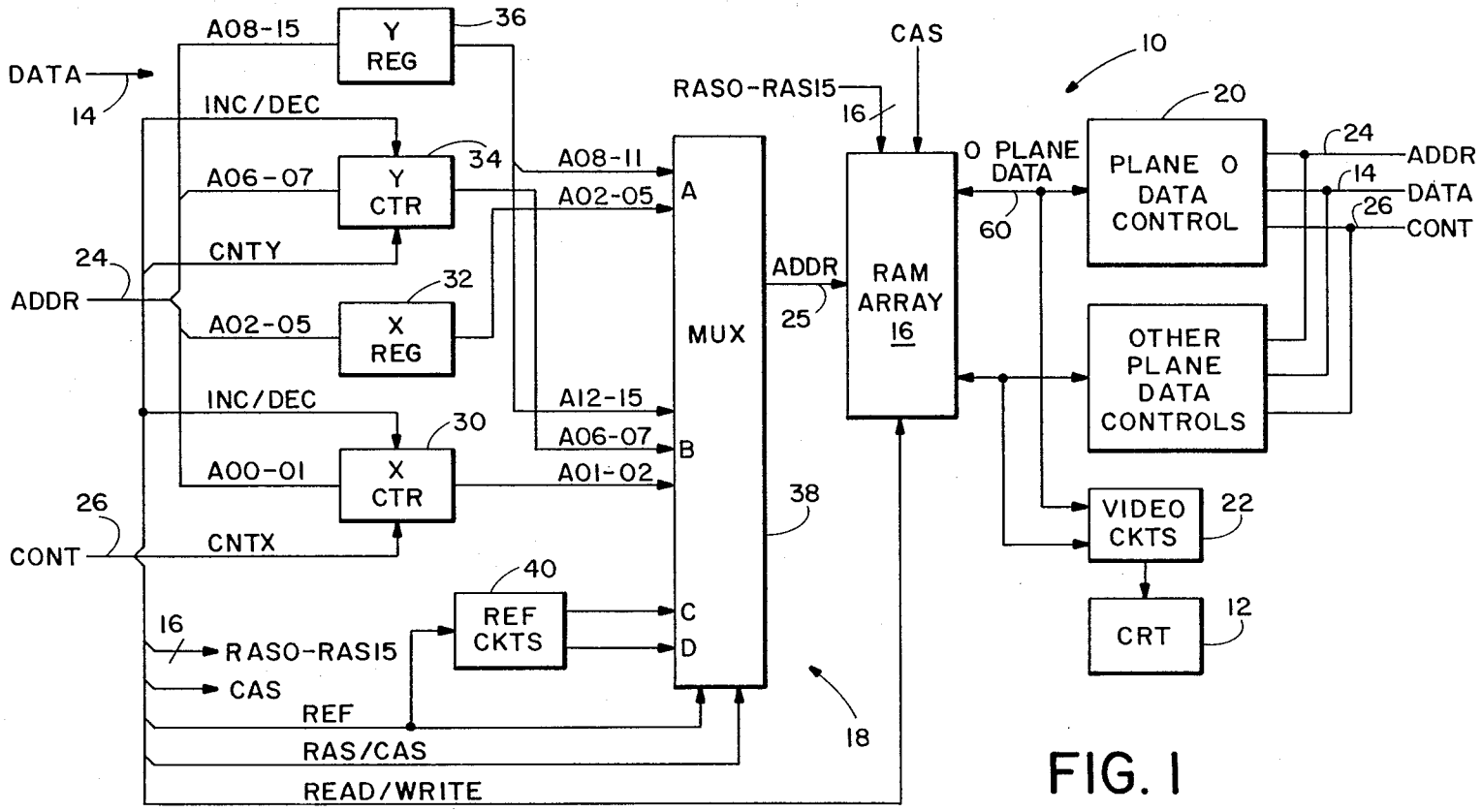

Referring to FIG. 1, a frame buffer memory system 10, depicted in block diagram form, is adapted to generate an image on cathode ray tube (CRT) 12 based on data transmitted over a sixteen bit data bus 14 from a controlling device such as a host computer or display processor system. The image on the CRT 12 is made up of pixels and the color or other attribute of each pixel is controlled by the state of a corresponding eight bit pixel data word. The frame buffer memory 10 comprises a random access memory (RAM) array 16 for storing the pixel data, a set of eight data controllers 20 for controlling the flow of data between the RAM array 16 and the data bus 14, an I/O controller 18 for controlling addressing of the RAM array 16, and a conventional video output circuit 22 for generating the appropriate CRT 12 refresh signals to achieve the desired display based on the pixel data stored in the RAM array 16.

RAM array 16 comprises a set of 128 64K×1 bit RAM chips arranged in an array of eight rows (planes) and sixteen columns. Each RAM chip is addressed by a sixteen bit word but has only eight address bus terminals connected to an eight bit address bus 25. Therefore each RAM chip in array 16 is of the type wherein addressing occurs in two steps. First an eight bit row address is placed on the RAM address bus 25 and a row address strobe (RAS) is applied to strobe the row address into the RAM chip. Then an eight bit column address is placed on the RAM address bus 25 and a column address strobe (CAS) is applied to strobe the column address into the RAM chip. Data is read from or written into the RAM at the row and column address according to the state of an applied read/write (R/W) control signal carried on control lines 26. A single CAS line is applied in common to each RAM chip of the array 16 while a separate RAS line labeled RAS0-RAS15 is applied in common to each of the eight RAM chips of each of the sixteen array 16 columns.

Each RAM chip has a data I/O terminal through which a single data bit is read from or written to the RAM chip. The data I/O terminals of all sixteen RAMs of each array plane are connected through a sixteen line data bus 60 to a corresponding data controller 20 so that each data controller 20 can send or receive sixteen bits of data to or from the sixteen RAM chips of a given plane during a memory write or a memory read operation. The data bus 60 of each array plane is also brought out to the video output circuits 22 to permit data to pass from array 16 to the video output circuits for screen refresh.

The first bit of each pixel is stored in plane 0 of array 16. The second bit of each pixel is stored in plane 1 at the same RAM address and in the same RAM array 16 column as the first bit of the pixel. In a similar fashion successive pixel bits of each pixel are stored in successive planes, the eighth bit of each pixel being stored in plane 7. Since each RAM chip of the array 16 comprises 64K storage locations and since there are 16 RAM chips in each plane of the array 16, a total of 64K ×16 or 1024K eight bit pixels may be stored in the array with sixteen pixels stored at each array address allowing, for example, a 1,024×1,024 pixel display.

During a memory write cycle, each data controller 20 transmits a sixteen bit word over the associated plane data bus 60 to the corresponding plane RAM 16, one bit being applied to each of the sixteen similarly addressed memory cells of the memory array 16 plane. Selected RAM columns in array 16 are RAS strobed at the same time and then every RAM is CAS strobed so that the data from the data controllers 20 may be written into the RAS strobed RAMs of the corresponding array 16 planes. Therefore from one to sixteen similarly addressed pixels may be changed in a single write cycle.

During a memory read cycle, each RAM in the array is RAS strobed and then CAS strobed so that data may be read from each RAM array 16 plane and transmitted to an associated data controller 20. Therefore one or more corresponding bits of each of sixteen similarly addressed pixels may be read in a single read cycle.

I/O controller 18 comprises counters 30 and 34, registers 32 and 36, refresh circuits 40 and multiplexer 38. During a read or a write access cycle, the current sixteen bit memory address is transmitted to I/O controller 18 from the display controller over an address bus 24. Address bits A00 and A01 of the current address are stored in X counter 30, bits A02–A05 are stored in X register 32, bits A06–A07 are stored in Y counter 34 and bits A08–A15 are stored in Y register 36. Once the two bit data values are stored in counters 30 and 32, either counter may then increment or decrement the stored count on receipt of a CNTX or CNTY pulse over control lines 26 from the display processor. The count direction (up or down) is determined by the state of a single bit INC/DEC indicating signal also transmitted to the X and Y counters over control line 26. The data stored in counters 30 and 34 and in registers 32 and 36 is applied to A and B inputs of 32/8 bit multiplexer 38 with bits A02–A05 and A08–A11 being applied to input A of multiplexer 38 and with bits A00, A01, A06, A07 and A12–A15 being applied to input B. During a memory read or write access, prior to a RAS strobe, multiplexer 38 is switched such that its input A is transmitted to its output, i. e. address line 25 to the RAM array 16. Therefore the eight bits applied to input A of multiplexer 38 comprise the row address for the array. Then, prior to a CAS strobe, multiplexer 38 is switched to pass the eight bits appearing at input B to address bus 25. Therefore the eight bits at input B comprise the column address for the array.

Eight bit row and column addresses are also generated by a conventional refresh counter in circuit 40 and applied to C and D inputs of multiplexer 38. During a screen refresh operation, the multiplexer 38 alternately applies the C and D inputs to the RAM array address bus as internal counters in the refresh circuit generate all combinations of the row and column addresses. A refresh operation is initiated by a single bit signal REF on control lines 26 from the display processor. The switching position of multiplexer 38 is also controlled by the REF signal and a single bit RAS/CAS signal on control lines 26.

The pixel data words are stored in each plane of memory array 16 in 4096 blocks, or "tiles", each having four rows, with four sixteen bit data words in each row as shown in FIG. 2. In FIG. 2 the large rectangle represents a tile while each small rectangle therein represents a sixteen bit pixel word. The sixty-four pixels of the four, sixteen bit data words of each tile row correspond to sixty four successive pixels of a raster line on the display of CRT 12, while the four rows of each tile correspond to four contiguous raster lines on the display. When the array is addressed, the particular one of the sixteen words currently addressed in each tile is determined by the same four address bits A00, A01, A06 and A07, each of which are column address strobed. The four bit address (A07, A06, A01, A00) of each word of a tile is shown in the corresponding small rectangle in FIG. 2. The other twelve bits of the sixteen bit memory array address determine which of the 4096 tiles of the array 16 are being accessed.

During a scrolling operation, where a section of the display is to be moved to another part of the screen, data is read from one area of the memory array 16 and rewritten to another area. In the present invention, the four words of a selected tile row or column may be read or written in rapid succession by generating a single RAS strobe on all the RAS0-RAS15 lines followed by a series of four CAS strobes, with the appropriate two of four tile address bits being incremented or decremented by X counter 30 or Y counter 34 of FIG. 1 prior to the CAS strobes. For instance, when scrolling the display horizontally, the twelve bit address of a particular tile, along with the four bit address of the first word in a selected tile row are generated by the display processor. These sixteen address bits are placed on address bus 24 and transmitted to the display buffer 10 where they are stored as described above in counters 30 and 34 and registers 32 and 36 and then applied to multiplexer 38. Initially A01 and A00 are both 0's. A07 or A06 may be any combination depending on which tile row is selected. The first data word of the selected tile row is then read and transmitted to the data controllers 20 after the first RAS and CAS strobes. The X counter 30 is pulsed with a CNTX signal while the INC/DEC signal is in a state indicating incremental counting, thereby incrementing A00 to a logical 1. A second CAS strobe is applied to the array 16 without an intervening RAS strobe such that the second word of the selected tile row is column addressed, read and then transmitted to the data controllers 20. Another RAS strobe is unnecessary because the row address of all words in the tile row is the same. The X counter 30 further increments the two bit A01, A00 word a second time such that A01 is set to a logical 1 while A00 is set to a logical 0, and then a third CAS strobe is applied to the array 16 to address the third word of the row. The two bit address is incremented again so that A01 and A00 are both logical 1's and a fourth CAS strobe is applied to the RAM array 16 thereafter so that the fourth data word in the selected tile row is read and transmitted to the data controllers 20. The four words thus read from each plane are stored in the associated data controller 20 and may be later written to a different tile of the array in a similar fashion, using a RAS strobe followed by four CAS strobes.

A data read or write operation for a vertical scroll would operate in a similar fashion except that the Y counter 34 increments or decrements the data bits A07 and A06 such that the four words of a selected tile column are successively read or written utilizing one RAS strobe followed by four CAS strobes. For an upward scroll, data words of a tile column are read and written from top to bottom. Therefore the Y counter 34 is incremented after, each CAS strobe. For a downward scroll, Y counter 34 is decremented after each CAS signal. When the left or right edge of a window to be vertically scrolled does not coincide with the first or last bit of a data word, the RAM chips storing pixels lying outside the window boundaries are not RAS strobed. Therefore only the data sets of a boundary word corresponding to pixels lying inside the window area are read and rewritten during a vertical scrolling operation.

Thus the tile arrangement of the present invention permits access to four successive memory words during a single memory read or write cycle. Since the four memory words accessed correspond to either vertically or horizontally contiguous pixels on the display 22, and since counters 30 and 34 can either increment or decrement the address, the four data words can be read left to right, right to left, top to bottom, or bottom to top. This allows rapid scrolling in any of four directions.

Figure 3:
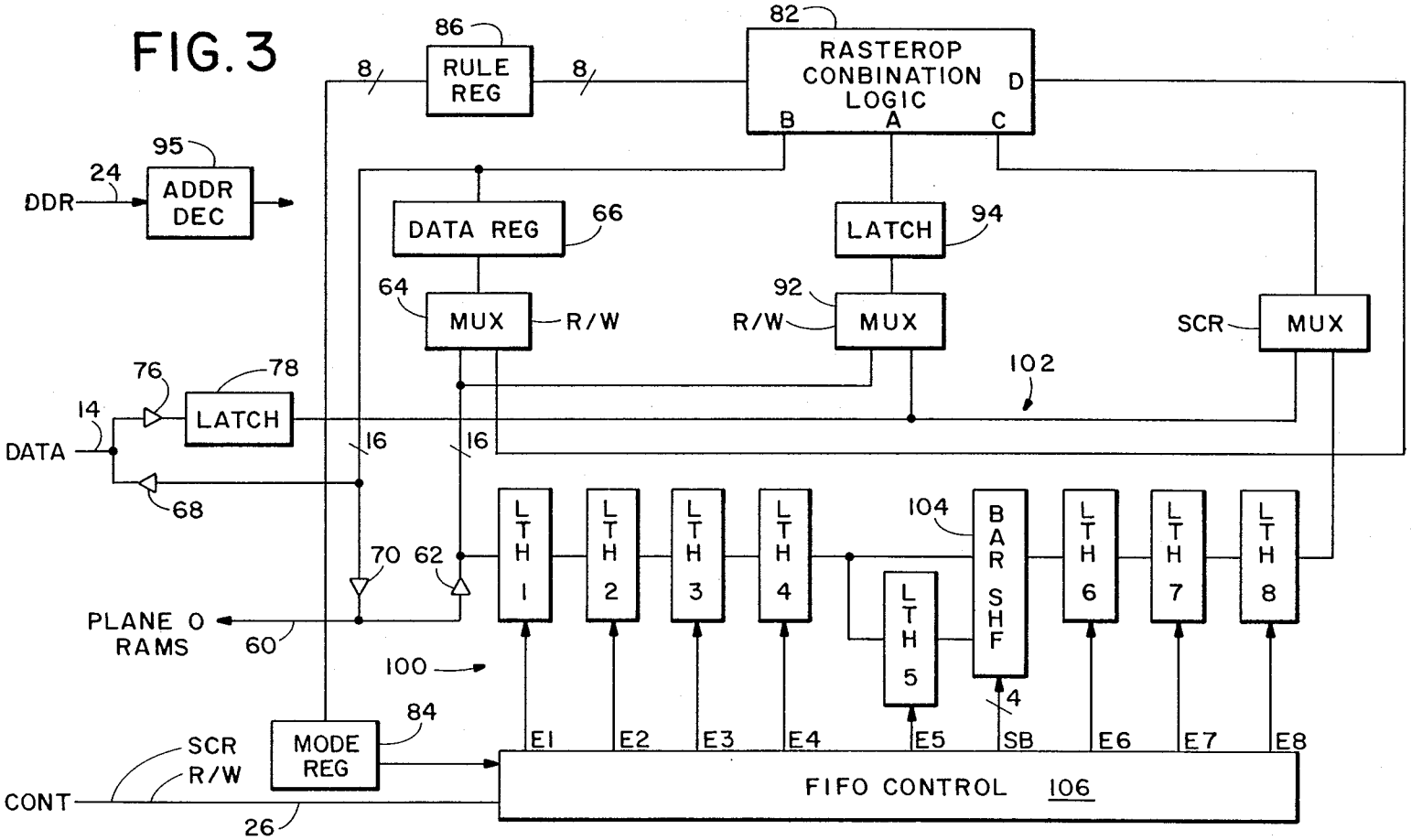

The plane 0 data controller 20 of FIG. 1 is depicted in more detailed block diagram form in FIG. 3. The topology and operation of each of the other data controllers associated with RAM planes 1–7 is similar. During a memory read cycle, single bit data read from each of the sixteen RAMs of any plane passes over data bus 60, through buffer 62 and 32/16 bit multiplexer 64, and into data register 66. The switching position of multiplexer 64 is controlled by a read/write indicating signal R/W transmitted over one control line 26 from the display processor. Once stored in data register 66, the sixteen bit data word from the plane may be transmitted to the display processor through buffer 68 and over data lines 14.

During a memory write cycle, data to be written into the plane 0 RAMs is initially stored in data register 66 and then transmitted to the RAMs through buffer 70 and over the plane 0 data bus 60. Prior to storage in register 66, in preparation for a memory write operation, the data to be written into memory is generated at an output D of a rasterop (raster operation) combination logic circuit 82 (described hereinbelow) and applied to a second sixteen bit input of multiplexer 64. Logic circuit 82 has three 16 bit inputs A, B and C and is adapted to generate the sixteen bit output word D, each bit of which is some selected Boolean combination of the corresponding bits of the three inputs A, B and C. The particular logical combination of inputs to be performed by logic circuit 82 is selected by preloading a rule register 86 with an eight bit word which is then applied to an input logic circuit 82. This eight bit data word is loaded into rule register 86 by transmitting it from the display processor over data bus 14 and through buffer 76 and latch 78.

Referring to FIG. 4, a preferred embodiment of rasterop logic circuit 82, depicted in block diagram form, comprises a set of sixteen 8/1 multiplexers 96, labeled MUX 0–MUX 15. Eight data lines (R0–R7), one bit each of the rule data stored by rule register 86, are applied to the eight input terminals of each multiplexer 96. The first bit (A0, B0 or C0) of each of the sixteen bit words appearing at the A, B and C input terminals of logic circuit 82 is applied to a corresponding one of three control inputs to MUX 0. Similarly, successive bits of the A, B and C inputs of logic circuit 82 are applied to the control inputs of successive multiplexers 96. The single bit output D0–D15 of each multiplexer of rasterop logic circuit 82 comprises a separate bit of the sixteen bit output D of logic circuit 82.

Each multiplexer 96 passes a data bit (a 0 or a 1) carried by one of the rule register 86 output lines R0–R7 to the associated multiplexer output line D0–D15, the R0–R7 line being selected according to the three bit code A0–A15, B0–B15, C0–C15 appearing at the control terminals of the multiplexer. Each multiplexer 96 may therefore be programmed to generate an output D0–D15 state on occurrence of any combination of the corresponding A0–A15, B0–B15, C0–C15 input states simply by storing the appropriate eight bit data in rule register 86 to appropriately set the states of the R0–R7 lines.

Referring again to FIG. 3, a sixteen bit data word may be transmitted from the display controller over data bus 14, through buffer 76, latch 78 and 32/16 bit multiplexer 80 and into input C of rasterop combination logic circuit 82. The switching position of multiplexer 80 is determined by a control bit (SCR) carried on control lines 26 from the display processor. The sixteen bit word thus transmitted by the display controller to input terminal C of logic circuit 82 may then be modified if desired by logic circuit 82 and passed through output D and multiplexer 64 to data register 66 for storage therein and subsequent writing to a selected address of the plane 0 RAM chips.

The 16 bit data word at input A of logic circuit 82 may be read from the plane 0 RAMs and transmitted through buffer 62 and 32/16 bit multiplexer 92 and latch 94 to terminal A, the switching state of multiplexer 92 being controlled by the same R/W control signal on control lines controlling the switching state of multiplexer 64. Alternatively, the data appearing at terminal A of logic circuit 82 may, during a memory write operation, be transmitted from the external control system to terminal A over data bus 14, and through buffer 76, latch 78, multiplexer 92 and latch 94. The sixteen bit word stored in data register 66 continuously appears at input B of logic circuit 82.

The loading of registers and latches 66, 70, 86 and 92 is controlled by strobe signals generated by address decoder 95 based on register address appearing in address bus 24.

During a scrolling operation, the data read from array 16 is stored in a first in, first out (FIFO) scrolling buffer 100 comprising a set of eight sixteen bit latches 102 (LATCH 1–LATCH 8), barrel shifter 104, and FIFO control circuit 106. Latches 1–5 are connected in series between the output of buffer 62 and one input of barrel shifter 104. The output of latch 4 is also applied to another input of barrel shifter 104. Latches 6–8 are connected in series between the output of barrel shifter 104 and one input of multiplexer 80. FIFO control circuit 106 selectively enables LATCHES 1–8 by energizing control lines E1–E8 connected thereto. With the latch enabled, the data appearing at its input also appears at its output such that the latch appears transparent to incoming data. When a control input is deenergized, the associated latch "latches" so that the latch output is fixed at its last state and is unaffected by latch input changes.

Data words read from array 16 during a scrolling operation pass from latch to latch in FIFO buffer 100. The sixteen bit output word of latch 4 and the sixteen bit output word of latch 5 comprise a thirty-two bit circular input word to barrel shifter 104. Barrel shifter 104 generates a sixteen bit output word comprising any selected sixteen consecutive bits of the thirty-two bit circular input word. The output of barrel shifter 104 becomes the input to latch 6. There are thirty different sets of sixteen consecutive bits in a thirty-two bit circular word and the particular set selected and outputted by the barrel shifter 104 is determined by a five bit data word SB applied to a shift control input of barrel shifter 104. This word is initially stored in a mode register 84 after having been generated by the display processor and transmitted to register 84 over data line 14, and through buffer 76 and latch 78. The SB word is then passed from mode register 84 through FIFO control circuit 106 to barrel shifter 104.

During a vertical scrolling operation, sets of four pixel data words of a tile column are read sequentially from array 16 using the RAS strobes followed by four CAS strobes as described above. The CAS signals are carried on control lines 26 to FIFO control circuit 106. A system clock signal is also applied to FIFO control circuit 106 over control lines 26. Initially all of the FIFO buffer latches 102 are unlatched such that they all appear transparent to input data. As each data word is read, it is applied to the input of latch 1 of FIFO buffer 100. On the first system clock signal following the first CAS signal, FIFO control circuit 106 deenegizes line E1 to latch 1 causing latch 1 to latch. Since all of the other latches are unlatched, the first data word falls through the buffer to the output of latch 5. For a vertical scrolling operation, the data SB applied to barrel shifter 104 is set such that the barrel shifter does not "shift", or in other words, the sixteen bit data at the output of latch 5 is passed through to latch 6 while the sixteen bits in latch 4 are ignored by barrel shifter 104.

The passage of data through most commercially available barrel shifters is relatively slow compared to the passage of data through a latch. Thus the first data word may not have time to pass through the barrel shifter 104 during the first system clock cycle. On the next system clock cycle, control circuit 106 latches latch 5 and unlatches latch 1. Thus, when the next data word is read following a second CAS signal and sent to the FIFO buffer, it passes through latches 1-4, but not latch 5. In the meantime, the first data word passes through the barrel shifter and at least through latch 6. On the first clock cycle following the second CAS strobe, control circuit 106 latches latch 6 and latch 1 and unlatches latch 5. The first data word passes to the output of latch 8 while progress of the second data word through the buffer is stopped at the output of latch 5. On the next clock cycle, latches 1 and 6 are unlatched while latches 5 and 8 are latched. If a third data word is read on occurrence of a third CAS signal, it passes through latch 1. On the first clock cycle after the third CAS signal, latches 1 and 6 are latched while latch 5 unlatches. Latch 8 remains latched. At this point the first data word appears at the output of latch 8, the second data word is halted at the input to latch 8, and the third data word is blocked at the input to latch 6. On the next clock cycle, latches 1 and 6 unlatch while latches 5 and 7 latch. At this point, the first data word appears at the output of latch 8, the second data word appears at the output of latch 7, and the third data word appears at the output of latch 5.

If a fourth data word is read following a fourth CAS strobe, it passes to latch 1. Latches 1 and 6 then latch while latch 5 unlatches, allowing the fourth data word to pass through to the output of latch 5. In a similar fashion, the fifth, sixth, seventh and eighth data words read from memory array 16 are backed up in FIFO buffer 100 at the inputs to latches 5, 4, 3, and 2 respectively. When the buffer is fully loaded with eight words, all latches remain latched.

At any time after the first data word is read and stored in FIFO buffer 100, the first word and any subsequently stored data words may be sequentially passed from the buffer, through multiplexer 80 to input C of rasterop combination logic circuit 82. Logic circuit 82 may, if programmed to do so, modify the data in some way, and then the modified or unmodified pixel data is passed from output D of logic circuit 82, through multiplexer 64 and into register 66. If the data was unmodified by rasterop combination circuit 82, it may be rewritten to some other address of memory array 16 corresponding to a higher or lower position of the display, thereby vertically scrolling the display.

Alternatively, logic circuit 82 may modify the data in some way, as for instance by changing a bit controlling pixel brightness or some other attribute, and the data may be written back to the same or another memory location. Thus the use of the logic circuit 82, in combination with the FIFO buffer 100, and the tile arrangement of memory array 16, provides rapid alteration of selected attributes of blocks or windows of the display, or rapid simultaneous altering and scrolling of the display window.

When data is to be unloaded from FIFO buffer 100 and written into memory array 16, multiplexer 80 is switched to pass data appearing at the output of latch 8 to input C of logic circuit 80 by the SCR signal on one line of control lines 26. This data may then be modified and written back into memory as described above. Another line of control lines 26 carries a scroll FIFO unload (SFU) signal which is applied to FIFO control circuit 106. This signal is generated on occurrence of each CAS signal during a buffer 100 unloading operation. When a CAS signal occurs, indicating that the data appearing at the output of latch 8 has been passed to register 66 and written back into memory array 16, the SFU signal goes low, temporarily. On the next clock signal, latch 8 is unlatched allowing the data at its input terminals to pass to its output. On the next following clock cycle, latch 8 is latched and latch 7 is unlatched, permitting the data at the latch 7 input to pass to the latch 8 input. The process continues with each clock cycle until all of the data stored in buffer 106 has been shifted by one latch. In the meantime, once latch 8 has latched the second data word appears at its output and may also be passed to register 66 and written to memory on the next CAS strobe. The FIFO control circuit continuously shifts data from latch to latch whenever the preceding data has been shifted.

The five latches preceding the barrel shifter 104 permit at least five data words to be read in rapid succession and stored in the buffer 100 regardless of the speed of the barrel shifter. Similarly, the three latches following barrel shifter 104 allow four data words to be unloaded from the buffer and written into memory in rapid succession as long as the barrel shifter 104 can process the fourth word during the time interval in which the set of four words is written to memory. Typically the time required for four data words to pass through the relatively slow barrel shifter is needed for other purposes, such as a screen refresh operation, and is therefore nonlimiting, provided that the barrel shifter is located in the middle of the buffer and not at either end.

During a horizontal scrolling operation, the barrel shifter 104 is set by the SB data in mode register 84 to select one sixteen bit subset of the data appearing at the outputs of latch 4 and latch 5 as its sixteen bit output. Since the thirty-two bits of the two input words correspond to thirtytwo horizontally contiguous pixels of a display, and since pixel data is read and written in sixteen pixel blocks, it may be necessary to shift the position of each pixel within a word by some number of bit positions after it is read but before it is rewritten back to the memory array 16. This bit position shifting is required if the distance of the horizontal shift is not a multiple of 16. The magnitude of the bit position shift corresponds to the number of bits of the data word appearing at the output of latch 4 that are incorporated into the data word appearing at the output of the barrel shifter 104 and is controlled by the SB control input to the barrel shifter. The direction of the bit position shift depends on whether the data in latch 4 is physically to the left or to the right of the data in latch 5 with reference to the relative positions of on the display of corresponding pixels.

The loading of the FIFO buffer 100 during a horizontal scrolling operation involving a bit position shift is generally similar to the loading of the buffer when no bit position shift is required except that latch 5 remains latched until latch 4 latches and latch 6 won't latch until after latch 4 latches. This ensures that two sequentially read data words appear at the outputs of latches 4 and 5, the inputs of barrel shifter 104, before the output of the barrel shifter is latched into latch 6.

When horizontally scrolling from left to right, the four data words in a tile row are read in right to left order and loaded into the buffer. Thus the X counter 30 is decremented after each CAS signal. If the left to right horizontal scroll involves a shift that is not an even multiple of sixteen pixels, then the barrel shifter is set to generate data words wherein the high order bits (rightmost) comprise an appropriate number of low order bits of the word in latch 5 while the low order bits comprise high order bits of the word in latch 4.

When horizontally scrolling from right to left, the four data words in a tile row are read in left to right order and loaded into the buffer. Thus the X counter 30 is incremented after each CAS signal. If the scroll involves a shift that is not an even multiple of sixteen pixels, then the barrel shifter is set to generate data words wherein the high order bits comprise an appropriate number of low order bits of the word in latch 4 while the low order bits comprise high order bits of the word in latch 5.

FIG. 5 is a block diagram of an embodiment of the FIFO control circuit 106 of FIG. 3. Control circuit 106 comprises a set of eight D-type flip-flops, FF1 to FF8, each having a Q output (labeled Q1 to Q8 for flip-flops FF1 to FF8 respectively) coupled through a buffer to a corresponding control line E1-E8 to a corresponding latch 102 of the FIFO buffer 100. Control circuit 106 also comprises a read only memory (ROM) 112 having eight data output lines, each one connected to a D input of a corresponding flip-flop 110. The D inputs are labeled D1 to D8 for flip-flops D1 to D8 respectively. The eight Q outputs of the eight flip-flops are also coupled to eight address line inputs of ROM 112. A set of four control lines 26 from the display processor, also applied to four other address line inputs of ROM 112, include the CAS line, a scroll FIFO load (SFL) line, a scroll FIFO unload (SFU) line, and a scroll FIFO clear (SFC) line. The five SB bits from mode register 84 are applied to the inputs of an OR gate 114 while the output of the OR gate is applied to still another address lie input of ROM 112. A clock signal CK carried on another control line 26 is applied in common to the clock inputs of all flip-flops 110.

The Q output of each flip-flop 110 changes state to match the current state of its D input whenever the flip-flop is strobed by a CLK pulse. ROM 112 in combination with flip-flops 110 comprises a state machine wherein the current state of the D input of each flip-flop can be made high or low depending on the collective states of all of the flip-flop 110 Q outputs together with the states of the other addressing inputs to the ROM. The rules of correspondence between the ROM inputs and outputs are established by the data stored in the ROM. FIG. 6 is a chart which expresses the relationship between the D1–D8 outputs of the ROM and all of the inputs thereto. For each output D1–8, there is listed a Boolean expression indicating under which input conditions the D output will be high. When the expression is true (a logical 1), the corresponding D output will be true, and when the expression is false, the D output will be low. With the data of ROM 112 adjusted to effect these expressions, loading and unloading of the FIFO buffer 100 will operate as previously described.

To clear data from the buffer, the SFC signal is driven low. At all other times SFC is high. A low SFC signal causes Q2, Q3, Q4, Q5, Q7 and Q8 to go high on the next clock CK cycle. Then, on a second CK cycle, Q1 and Q6 go high. With all of the Q outputs high, the E control inputs to all of the latches of buffer 100 go high, making them all transparent. Initially, when there is no data stored in FIFO buffer 100, all of the Q outputs of flip-flops 110 are high so that all of the latches are transparent. The CAS signal is used in the expression for D1 to cause latch 1 to latch after each CAS signal. The SFL signal is normally low except when the display controller wishes to load data into the buffer 100. In such case, SFL is driven high at the same time as the CAS signal, and stays high for one CK cycle thereafter. The ZSN signal from OR gate 114 of FIG. 5 is high if any one of the SB bits is high, indicating that the barrel shifter is shifting pixel bit positions of the data passing through it. The ZSN signal is used in the expressions of D5 and D6 to prevent latch 6 from latching or latch 5 from unlatching until latch 4 latches. The SFU signal is high except when the display controller has read data from the buffer. Then the SFU signal is driven low for one CK cycle to initiate a shift of data through the buffer. The SFU signal is therefore used in the expression for D8, causing D8 to go high when SFU goes low such that on the next CK cycle Q8 goes high to unlatch latch 8.

While it is possible that FIFO buffer 100 could operate asynchronously, passing data from latch to latch without regard to a system clock, the synchronous FIFO buffer of the present invention requires latching to occur in concert with the system clock. Therefore the display controller can keep track of where data is in the FIFO buffer at any given instant and can access the buffer without requiring asynchronous control signals such as input ready or output ready.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. An apparatus, responsive to control, address and data signals from a computer, for storing pixel data representing a screen image consisting of rows and columns of pixels, each pixel having display attributes controlled according to associated stored pixel data, said apparatus comprising:

a random access memory comprising addressable storage locations, each storage location being fixedly associated with a separate horizontally contiguous set of said pixels, each storage location storing a pixel data word comprising pixel data controlling display attributes of said pixels associated with said storage location;

an input/output controller for storing an address conveyed from said computer by said address signals, for addressing a storage location in said random access memory in accordance with said stored address, and for selectively incrementing/decrementing first and second portions of said stored address in accordance with ones of said control signals, said pixel data words being stored in said random access memory at storage locations such that when said first portion of said stored address is selectively incremented/decremented, a new storage location addressed in accordance with said stored address is associated with a first set of pixels horizontally adjacent to a second set of pixels associated with a storage location last addressed by said stored address, and such that when said second portion of said stored address is selectively incremented/decremented, said new storage location addressed in accordance with said stored address is associated with a third set of pixels vertically adjacent to said second set of pixels; and a data controller repsonsive to others of said control signals for reading pixel data words stored in said random access memory at storage locations addressed by said input/output controller, and for writing pixel data words into said ramdom access memory at storage locations addressed by said input/output controller.

2. An apparatus, responsive to control, address and data signals from a computer, for storing pixel data representing a screen image consisting of rows and columns of pixels, each pixel having display attributes controlled according to associated stored pixel data, said apparatus comprising:

a random access memory comprising addressable storage locations, each storage location being fixedly associated with a separate horizontally contiguous set of said pixels, each storage location storing a pixel data word comprising pixel data controlling display attributes of the set of said pixels associated with said storage location;

an input/output controller for storing an address conveyed from said computer by said address signals, and for addressing a storage location in said ramdom access memory in accordance with said stored address; and a data controller responsive to said control signals from said computer, said data controller comprising means for receiving input pixel data words conveyed by said data signals from said computer, means for reading pixel data words stored in said random access memory at storage locations addressed by said input/output controller, means for modifying pixel data words read to produce modified pixel data words, and means for writing said input pixel data words and said modified pixel data words into said random access memory at storage locations addressed by said input/output controller.

3. The apparatus in accordance with claim 2 wherein said means for modifying pixel data words read to produce modified pixel data words comprises:

means for storing a plurality of pixel data words read out of said random access memory; and means for producing ones of said modified pixel data words each comprising portions of two of said plurality of pixel data words stored in said means for storing a plurality of pixel data words.

4. The apparatus in accordance with claim 2 wherein said means for modifying pixel data words read to produce modified pixel data words comprises:

means for storing a data word transmitted thereto by said computer via said data signal; and means for logically combining said data word and pixel data words read out of said random access memory to produce ones of said modified pixel data words.

5. The apparatus in accordance with claim 2 wherein said means for modifying pixel data words read to produce modified pixel data words comprises:

means for storing a data word transmitted thereto by said computer via said data signal; and means for logically combining said data word, said input pixel data words and pixel data words read out of said random access memory to produce said modified pixel data words for storage in said ramdom access memory.

6. An apparatus responsive to control, address and data signals from a computer for storing pixel data representing a screen image consisting of rows and columns of pixels, each pixel having display attributes controlled according to associated stored pixel data, said apparatus comprising:

a random access memory comprising addressable storage locations, each storage location being fixedly associated with a separate horizontally contiguous set of said pixels, each storage location storing a pixel data word comprising pixel data controlling display attributes of the set of said pixels associated with said storage location;

an input/output controller for storing an address conveyed from said computer by said address signals, for addressing a storage location in said random access memory in accordance with said stored address, and for selectively incrementing or decrementing first and second portions of said stored address in accordance with ones of said control signals, said pixel data words being stored in said random access memory at storage locations such that when said first portion of said stored address is selectively incremented or decremented, a new storage location addressed in accordance with said stored address is associated with a first set of pixels horizontally adjacent to a second set pixels associated with pixel data stored in a last addressed storage location last addressed by said stored address, and such that when said second portion of said stored address is selectively incremented or decremented, said new storage location addressed by said stored address is associated with a third set of pixels vertically adjacent to said second set of pixels; and a data controller responsive to others of said control signals for reading pixel data words stored in said random access memory at storage locations addressed by said input/output controller, for receiving pixel data words transmitted from said computer via said data signals, means for transmitting pixel data words read to said computer, means for modifying pixel data words read to produce modified pixel data words, and means for writing pixel data words read, pixel data words received from said computer and said modified pixel data words into said random access memory at storage locations addressed by said input/output controller.

7. The apparatus in accordance with claim 6 wherein said means for modifying pixel data words read to produce modified pixel data words comprises:

means for storing a plurality of pixel data words read out of said random access memory; and means for producing ones of said modified pixel data words each comprising portions of two of said plurality of pixel data words stored in said means for storing a plurality of pixel data words.

8. The apparatus in accordance with claim 6 wherein said means for modifying pixel data words read to produce modified pixel data words comprises:

means for storing a data word transmitted thereto by said computer via said data signal; and means for logically combining said data word and pixel data words read out of said ramdom access memory to produce ones of said modified pixel data words.

9. The apparatus in accordance with claim 6 wherein said means for modifying pixel data words read to produce modified pixel data words comprises:

means for storing a data word transmitted thereto by said computer via said data signal; and means for logically combining said data word, said input pixel data words and pixel data words read out of said ramdom access memory to produce said modified pixel data words for storage in said random access memroy.

10. A method for defining a display comprising rows and columns of pixels, each such pixel having display attributes controlled accoridng to associated stored pixel data, said method comprising the steps of:

storing said pixel data in a random access memory comprising addressable storage locations, each storage location being fixedly associated with a separate horizontally contiguous set of said pixels, each storage location storing a pixel data word comprising pixel data controlling attributes of the set of said pixels associated with said storage location;

storing an address conveyed from a computer;

addressing a storage location in said random access memory in accordance with said stored address;

selectively incrementing or decrementing first and second portions of said stored address in accordance with control signals from said computer, said pixel data words being stored in said random access memory at storage locations such that when said first portion of said stored address is selectively incremented or decremented, a new storage location addressed in accordance with said stored address is associated with a first set of pixels horizontally adjacent to a second set pixels associated with pixel data stored in a storage location last addressed by said stored address, and such that when said second portion of said stored address is selectively incremented or decremented, said new memory address defined by said stored address is associated with a third set of pixels vertically adjacent to said second set of pixels;

reading pixel data words stored in said random access memory at storage locations addressed by said stored address;

modifying pixel data words read to produce modified pixel data words; and writing said modified pixel data words into said random access memory at storage locations addressed by said stored address.

11. The method in accordance with claim 10 wherein the step of modifying pixel data words read to produce modified pixel data words comprises the step of combining portions of pairs of pixel data words read.

* * * * *